United States Patent [19]

Cantor et al.

[11] Patent Number: 4,701,105

[45] Date of Patent: Oct. 20, 1987

[54] ANTI-ROTATION FEATURE FOR A TURBINE ROTOR FACEPLATE

[75] Inventors: Eugene Cantor; Thomas A. Farrand, both of Glastonbury, Conn.

[73] Assignee: United Technologies Corporation, Hartford, Conn.

[21] Appl. No.: 837,968

[22] Filed: Mar. 10, 1986

[51] Int. Cl.[4] ..... F01D 5/18; F01D 5/32

[52] U.S. Cl. ..... 416/95; 416/220 R

[58] Field of Search ..... 416/220 R, 193 A, 95, 416/219 R

[56] References Cited

U.S. PATENT DOCUMENTS

| | | | |
|---|---|---|---|
| 3,295,825 | 1/1967 | Hall | 416/221 |
| 3,728,042 | 4/1973 | Hugoson | 416/95 |
| 3,768,924 | 10/1973 | Corsmeier et al. | 416/95 |
| 3,814,539 | 6/1974 | Klompas | 416/220 X |
| 4,019,833 | 4/1977 | Gale | 416/95 X |
| 4,247,257 | 1/1981 | Benoist et al. | 416/95 X |
| 4,344,740 | 8/1982 | Trenschel et al. | 416/193 A X |
| 4,526,508 | 7/1985 | Antonellis et al. | 416/198 A X |
| 4,558,988 | 12/1985 | Kisling et al. | 416/220 |
| 4,582,467 | 4/1986 | Kisling | 416/95 |

FOREIGN PATENT DOCUMENTS

| | | | |
|---|---|---|---|
| 91865 | 10/1983 | European Pat. Off. | 416/216 |

*Primary Examiner*—Everette A. Powell, Jr.
*Attorney, Agent, or Firm*—Troxell K. Snyder

[57] ABSTRACT

A turbine rotor disk assembly for an axial flow gas turbine engine includes a rotor disk (18) and a faceplate (22) axially engaged therewith by rotationally engaged securing means such as a pair of corresponding hooked members (42, 44). Disengagement of the faceplate (22) and the rotor disk (18) is prevented by the cooperation of an axially projecting tab (58), integral with the turbine blade, (20) and a corresponding faceplate recess (60).

4 Claims, 3 Drawing Figures

ANTI-ROTATION FEATURE FOR A TURBINE ROTOR FACEPLATE

CROSS REFERENCE TO RELATED APPLICATION

Attention is hereby directed to co-pending, commonly assigned U.S. patent application Ser. No. 794,807, "A Sideplate for Turbine Disk", filed Nov. 11, 1985 and incorporated herein by reference.

FIELD OF THE INVENTION

The present invention relates to a gas turbine rotor assembly, and more particularly, to a turbine rotor assembly for distributing a flow of cooling air to the turbine blades.

BACKGROUND

The first rotating turbine stage in an axial flow gas turbine engine is subject to the harshest combination of environmental factors, including surface temperature, materials stress, etc. The turbine blades, disposed about the periphery of the rotor disk, interact with the hot engine working gas at temperatures commonly in excess of 2000° F. (1100° C.), while the rotor disk itself is subject to high radial loading induced by the rapid angular velocity of the spinning stage.

It is common in modern high performance gas turbine engines to protect the turbine blades with relatively cool compressed air. This flow of air is received by the blade at the radially inward attachment portion and distributed throughout by internal airflow passages, exiting the individual blade through a series of small openings at the blade surface or from the root portion.

The compressed air is provided by the upstream compressor section of the gas turbine and is available at the turbine disk in an axially flowing, annular stream. This annular stream, having inwardly bypassed the combustor section, is radially inward of the turbine blades and must therefore be redirected and distributed outward. This distribution is commonly effected through a manifold formed by securing an axially spaced faceplate to the turbine disk thus providing a radial passage for the annular compressed airstream to the blades. It will be appreciated by those skilled in the art that the addition of a faceplate is preferable to providing air flow paths within the highly loaded rotor disk, avoiding stress concentrations which may in turn reduce disk strength or induce premature disk cracking.

The securing of the faceplate to the disk must involve some type of cooperative mechanical engagement therebetween. The use of bolts or other fasteners which require perforating the disk and/or faceplate is to be avoided to the extent possible for the reasons just noted. One technique known in the prior art for axially securing at least a portion of the faceplate to the disk is by the use of a plurality of corresponding hooked protrusions or dogs disposed in both the faceplate and the rotor disk.

During assembly, the disk and faceplate are placed into axial contact with the hooked protrusions of the faceplate disposed intermediate the corresponding hooked protrusions of the disk, the disk and faceplate subsequently rotated each with respect to the other for aligning and engaging the corresponding hooked protrusions. This engagement opens up radial flow passages intermediate the engaged dogs, allowing a free flow of cooling air to the turbine blades.

The faceplate and disk remain thus engaged so long as relative rotation between the disk and faceplate does not occur. Even a slight relative rotational displacement, not sufficient to disengage the dogs, may block off a portion of the radial airflow paths leading to a reduction of cooling airflow and eventual blade overheating. Prior art methods for preventing such relative rotational displacement include the use of bolts or locating pins inserted between the faceplate and rotor following assembly. Prior art manifold systems and anti-rotation structures are well disclosed in U.S. Pat. Nos. 3,010,696 and 4,435,123 issued respectively to Everett and Levine.

The prior art methods, while effective, require holes to be provided in the disk and faceplate, leading to undesirable local stresses in the corresponding member. In addition, the presence of bolts or locating pins along with their associated retaining structure increases both the number of individual parts and complexity of the turbine rotor stage as well as the likelihood that the faceplate and/or disk may be scratched or damaged during assembly.

SUMMARY OF THE INVENTION

It is an object of the present invention to provide a means for restraining relative rotation between a turbine rotor disk and an axially secured faceplate.

It is further an object of the present invention to provide a restraining means that does not weaken the rotor disk.

It is still further an object of the present invention to provide a restraining means integral with the turbine blades and operable to indicate improper alignment of the faceplate and rotor disk during assembly.

The present invention provides a rotor disk and faceplate assembly axially secured by a plurality of corresponding hooked protrusions or dogs engaged by rotating the faceplate relative to the disk into a preselected relative angular orientation. The secured faceplate and disk define an air manifold for radially distributing an annular flow of compressed cooling air to the attachment portions of individual turbine blades secured about the disk periphery. Internal airflow passages in the blades distribute the cooling air within the blade airfoils.

Undesirable rotation between the dogged faceplate and disk is restrained by the cooperation of a plurality of axially extending tabs on the individual turbine blades which are received in a corresponding plurality of recesses disposed in the faceplate. In the preferred embodiment attachment portions of the turbine blades are received in shouldered slots disposed in the disk periphery. The attachment portions, configured to fit closely within the shouldered disk slots, are axially slidable into full engagement with the disk only when the faceplate recesses are aligned with the blade slots, indicating proper relative angular orientation of the disk and faceplate.

DETAILED DESCRIPTION OF THE INVENTION

Figure 1:
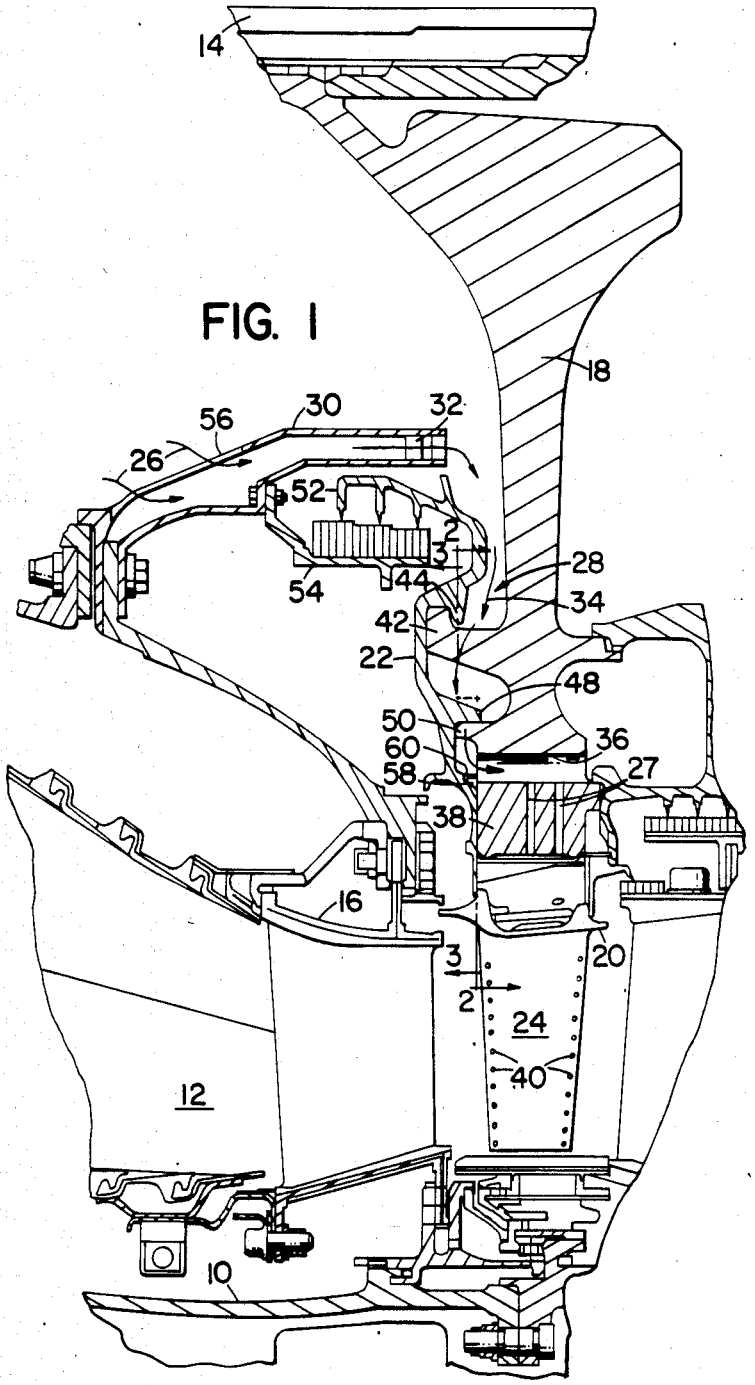
FIG. 1 shows an axial cross section of a rotating turbine stage according to the present invention.

FIG. 1 shows a partial axial cross section of a first turbine rotor stage of a gas turbine engine. Major components of the turbine engine are an outer case 10, a combustor 12, a central engine shaft 14, and a combustor exit nozzle 16. The rotor assembly comprises a rotor disk 18, keyed or splined to the shaft 14, a plurality of blades 20 disposed about the peripheral rim of the disk 18 and secured thereto, and a faceplate 22.

During turbine operation, hot working gas discharged from the combustor nozzle 16 flows rapidly past an airfoil portion 24 of the turbine blade 20, experiencing a linear momentum change and inducing the rotor assembly to turn.

As discussed hereinabove, the working gas discharged from the combustor nozzle 16 has typically been heated to temperatures in excess of 2000° F. (1100° C.) by the combustion process. Such high temperature gas, if directed against an unprotected turbine blade, causes rapid material wastage which eventually results in turbine performance degradation. According to the present invention, cooling air is conducted from a pressurized annular flow 26 of relatively cool air into airflow cooling passages 27 within the turbine blade 20 through a manifold region 28 formed between the faceplate 22 and the rotor disk 18. As shown in FIG. 1, the annular stream of pressurized cooling air 26 is received within an annular nozzle 30 and discharged therefrom with an angular velocity component induced by nozzle discharge turning vanes 32. The cooling air discharged from the nozzle 32 flows radially outward 34 in the manifold region 28, eventually entering an axial flow channel 36 formed between the rotor disk 18 and an attachment portion 38 of the turbine blade 20.

The cooling air in the flow channel 36 enters the blade 20 through at least one flow opening in the attachment portion 38, subsequently flowing through one or more internal airflow passages 27 within the blade 20 and thereby cooling the heated airfoil portion 24. The cooling air is discharged from the interior of the blade 20 either through a series of discharge openings 40 disposed in the blade surface, or by other routes well known in the art of turbine blade internal cooling.

The present invention provides a turbine rotor stage assembly wherein the faceplate 22 is axially secured to the rotor disk 18 by a rotationally engaged securing means such as a plurality of hooked projections 42, 44 which are cooperatively engaged by relative angular displacement of the faceplate 22 with respect to the rotor disk 18. These hooked projections, or dogs, each include an axially extending portion and a radially extending portion, each hooked member so extending in a direction opposite to that of the corresponding member so as to result in a radial overlap and an axial interference as shown in FIG. 1.

Figure 2:
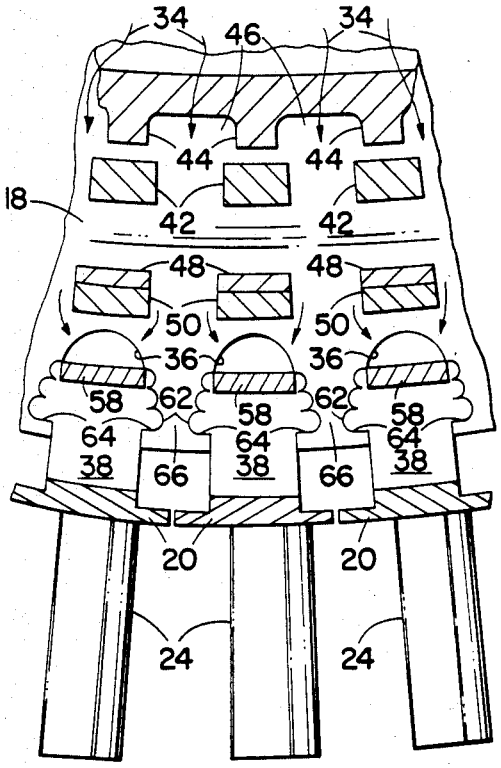
FIG. 2 shows a partial radial cross section of the stage looking downstream toward the disk.

FIG. 2 shows the radial cross sectional view of the assembled faceplate 22 and disk 18 as indicated in FIG. 1. The respective dogs 42, 44 are radially aligned leaving radial flow paths 46 for the radially flowing cooling air 34. The preferred embodiment of the present invention also includes corresponding shoulder lugs 48, 50 extending respectively axially rearward and forward from the respective faceplate 22 and rotor disk 18. The lugs 48, 50, are radially aligned with the respective dogs 44, 42 in the faceplate 22 and disk 18, providing a clear radial flowpath for the cooling air 34 therebetween. Lug 48 is disposed radially inwardly adjacent lug 50 when the faceplate 22 and disk 18 are fully axially engaged, thus providing a means for transferring into the rotor disk 18 any outward radial loading induced in the faceplate 20 by rotation.

The faceplate 22 also includes a radially inward knife edge portion 52 for contacting a corresponding annular honeycomb section 54 for sealing the inner annular volume 56.

Relative rotation between the faceplate 22 and the disk 18 is prevented in the preferred embodiment of the present invention by axially protruding index tabs 58 integral with the attachment portions 38 of the turbine blades 20. The index tabs 58 are received in corresponding recesses 60 disposed in the faceplate 22 and opening axially rearward. The recesses are located in the faceplate 22 so as to be aligned for receiving the tabs 58 only when the faceplate 22 and the rotor disk 18 are in a relative angular position corresponding to full engagement of the dogs 44, 42 and shoulders 48, 50.

The blades 20 are preferably engaged with the periphery of the disk 18 against relative radial movement by a plurality of axially oriented shouldered slots 62. The slots each contain radially facing shoulder portions 64 as shown in FIG. 2. The root portions 38 of the turbine blades 20 are configured to fit closely within the shouldered grooves 62, and are slid axially into the rotor disk 18 during assembly.

If the faceplate 22 and disk 18 are misaligned from the fully engaged relative angular orientation, the recess 60 is not properly positioned for receiving the axially extending tab 58 during subsequent insertion of the blades 20 into the rotor disk 18. The tab 58 thus encounters the faceplate 22 intermediate the recess 60, prohibiting the blade 20 from being fully inserted into the rotor disk 18. The tab 58 and the recess 60 of the present invention thus provide a positive indication of any misalignment between the face plate 22 and the rotor 18 during the rotor stage assembly procedure.

Figure 3:
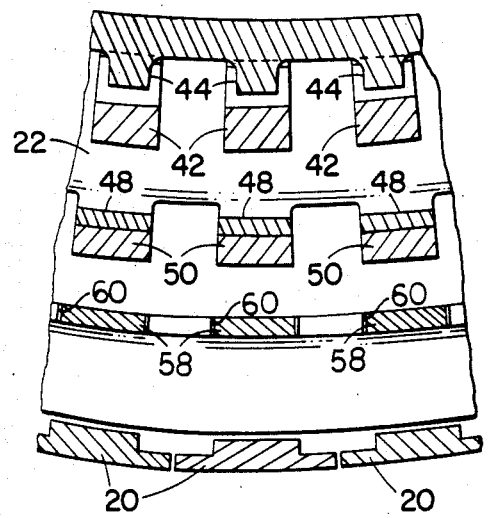
FIG. 3 is a cross section as in FIG. 2, but looking upstream toward the faceplate.

FIG. 3 shows a radial cross section as indicated in FIG. 1, looking in the opposite axial direction from that of FIG. 2, and clearly showing the tabs 58 received within the recesses 60. The engagement of the dogs 44, 42 and shoulders 48, 50 is also shown.

FIGS. 2 and 3 additionally show the dogs 44, 42, shoulders 48, 50, and turbine blade slots disposed 62 along equally angularly spaced radial lines. This alignment provides not only the unimpaired outward radial flow path 46 for the cooling air flow 34, but also distributes any radial stresses induced in the rotor disk 18 by the faceplate 22 more evenly about the circumference of the disk 18.

As will be appreciated from FIG. 2, the blades 20 are radially restrained by the radially inward facing shoulders 64 as described above. The radial load is thus concentrated at the disk periphery in the land portions 66 intermediate the shouldered slots 64, whereas those portions of the disk 18 directly radially inward of the axial flow channels 36 are subject to very low tensile radial stress. By placing the cooperating dogs 44, 42 and shoulders 48, 50 directly radially inward of the turbine blade roots 38 and angularly intermediate the land portions 66, the rotor assembly according to the present invention distributes the tensile stress in the rotor disk 18 more evenly and avoids undesirable local stress concentrations and gradients which may eventually induce local cracking or other component degradation.

What is claimed is:

1. An air cooled, rotating turbine stage assembly, comprising:

a turbine rotor disk including a plurality of circumferentially shouldered slots disposed about the outer periphery thereof;

a plurality of turbine blades, each including a radially inwardly disposed attachment portion, the attachment portion being slidably receivable within a corresponding disk shouldered slot for engaging the blade and the disk;

a faceplate axially secured to the disk by a plurality of cooperating hooked members extending axially between the faceplate and the disk, the disk and faceplate cooperatively defining a plurality of closed airflow paths intermediate the hooked members for directing an annular flow of compressed cooling air radially outward to the internal airflow passages of the blades;

a plurality of tabs, each integral with a corresponding turbine blade and extending axially therefrom, the tab being receivable within a corresponding recess in the faceplate when the faceplate and disk are in a desired relative angular orientation;

a plurality of support lugs extending axially in opposite directions between the faceplate and the disk, the corresponding lugs contacting radially for transferring rotationally induced radial forces from the faceplate to the disk; and wherein each engaged hooked member, faceplate recess, shouldered slot, and blade tab is disposed along one of a plurality of angularly uniformly spaced radial lines with each other corresponding engaged hooked member, faceplate recess, shouldered slot, and tab, thereby distributing rotationally induced forces throughout the disk.

2. An axial flow gas turbine engine having a turbine stage including a rotor disk, a plurality of turbine blades, each blade including an attachment portion slidably receivable in a corresponding slot disposed in the periphery of the rotor disk, said attachment portion being fully slidably received within said corresponding shoulder only when an axially extending tab, integral with each corresponding turbine blade, is received within a recess formed in an annular faceplate disposed axially adjacent the disk, means for axially securing the faceplate to the disk responsive to relative angular movement therebetween, the faceplate and the rotor disk forming a manifold therebetween for conducting an axially flowing annular stream of compressed cooling air radially outward into cooling passages disposed within each turbine blade, the axially securing means further including a plurality of axially extending hooked members, the hooked members being engageable and releaseable responsive to the relative angular movement between the faceplate and the rotor disk, the engaged hooked members each further being radially colinear with said corresponding shouldered slots for distributing any transferred, rotationally induced, radial forces from the faceplate to the rotor disk.

3. The improved rotor assembly as recited in claim 2, further comprising a plurality of corresponding axially extending support lugs disposed in the faceplate and the disk, the corresponding lugs being radially engaged for transferring rotationally induced radial forces from the faceplate to the rotor disk when the hooked members are engaged, and wherein each corresponding hooked member support lug, tab, faceplate recess, and disk slot are disposed along a corresponding radial line for providing a direct radial airflow path for the cooling air intermediate adjacent corresponding radial lines.

4. A bladed rotor stage for an axial flow gas turbine engine, comprising:

a disk having a peripheral rim;

a plurality of axial slots disposed about the disk rim, each slot including a radially inward facing shoulder;

a plurality of rotor blades, each blade having an attachment portion axially slidably receivable within a corresponding slot, each blade further including an internal cooling airflow passage for receiving cooling air at the attachment portion for distribution within the blade;

an annular faceplate, disposed axially spaced apart from the disk and defining therewith a cooling air manifold for distributing a flow of compressed cooling air radially outward into the cooling airflow passages of the blades;

a plurality of angularly spaced, cooperative, hooked axial projections, disposed in the faceplate and the disk, the hooked projections being responsive to relative rotation of the faceplate and the disk between a first, unengaged relative angular position and a second, engaged relative position;

a plurality of axially projecting tabs, each secured to an attachment portion of an individual blade;

a plurality of individual recesses disposed in the faceplate, each recess opening axially for receiving a corresponding projecting tab therewithin, the recesses being oriented for receiving the tabs therewithin only when the disk and faceplate are in the second, engaged relative angular position;

a plurality of corresponding support lugs, disposed in the faceplate and the disk and extending axially therebetween, the corresponding faceplate support lugs radially outwardly contacting the corresponding disk support lugs when the faceplate and disk are in the second, engaged relative angular position; and wherein each corresponding engaged hooked member, engaged support member, faceplate recess, tab, axial slot, and blade attachment portion are radially aligned when the faceplate and disk are in the second, engaged relative angular positon.

* * * * *